US010808919B1

(12) United States Patent
Chen et al.

(10) Patent No.: US 10,808,919 B1
(45) Date of Patent: Oct. 20, 2020

(54) LAMP FIXTURE AND EMERGENCY LIGHT COMPRISING THE SAME

(71) Applicant: HUIYANG DIYU INDUSTRY CO., LTD., Huizhou (CN)

(72) Inventors: Huashui Chen, Huizhou (CN); Jiqiang Xing, Huizhou (CN)

(73) Assignee: HUIYANG DIYU INDUSTRY CO., LTD., Huizhou (CN)

( * ) Notice: Subject to any disclaimer, the term of this patent is extended or adjusted under 35 U.S.C. 154(b) by 0 days.

(21) Appl. No.: 16/852,525

(22) Filed: Apr. 19, 2020

(30) Foreign Application Priority Data

Dec. 27, 2019 (CN) ..... 2019 2 2391176 U

(51) Int. Cl.
*F21V 21/14* (2006.01)
*F21V 33/00* (2006.01)
*F21V 15/01* (2006.01)

(52) U.S. Cl.
CPC ..... *F21V 21/14* (2013.01); *F21V 15/01* (2013.01); *F21V 33/0076* (2013.01)

(58) Field of Classification Search
CPC ..... F21V 21/14; F21V 33/0076; F21V 15/01; F21V 21/30; F21V 14/02; F21S 8/03; F21S 8/046; F21S 8/033; F21S 9/022
See application file for complete search history.

(56) References Cited

U.S. PATENT DOCUMENTS

| | | | | |
|---|---|---|---|---|
| 6,606,808 | B2 * | 8/2003 | Katz | G09F 13/04 362/234 |
| 8,911,134 | B2 * | 12/2014 | Hsu | G09F 13/22 362/613 |
| 10,107,480 | B1 * | 10/2018 | Ladewig | F21V 23/0471 |
| 10,332,368 | B2 * | 6/2019 | Kim | G06F 21/44 |
| 10,544,928 | B2 * | 1/2020 | Brunelli | F21S 9/022 |
| 2008/0276509 | A1 * | 11/2008 | Yu | G09F 13/04 40/570 |

* cited by examiner

*Primary Examiner* — Peggy A Neils
(74) *Attorney, Agent, or Firm* — Matthias Scholl P.C.; Matthias Scholl

(57) ABSTRACT

A lamp fixture, including a first bracket, a second bracket, a rotary joint, and a lamp. The second bracket includes a first subunit and a second subunit. The second bracket is rotatably connected to the first bracket. The second bracket is connected to the lamp through the rotary joint. The rotary joint is rotatably connected to the second bracket. The first bracket includes an end face opposite to the second bracket. The end face protrudes to form a first connecting block, and the end face includes a plurality of first V-shaped grooves circumferentially disposed around the first connecting block. The second bracket includes an end face opposite to the first bracket. The end face includes a first bulge corresponding to the plurality of first V-shaped grooves. The end face includes a first through hole to receive the first connecting block.

10 Claims, 10 Drawing Sheets

LAMP FIXTURE AND EMERGENCY LIGHT COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 201922391176.5 filed Dec. 27, 2019, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure related to field of emergency light apparatuses, and more particularly to a lamp fixture and an emergency light comprising the same.

Existing emergency lights are fixedly disposed on a bracket or a wall in a fixed angle and cannot move and rotate.

SUMMARY

The disclosure provides a lamp fixture comprising a first bracket, a second bracket, a rotary joint, and a lamp. The second bracket comprises a first subunit and a second subunit. The second bracket is rotatably connected to the first bracket, the second bracket is connected to the lamp through the rotary joint, and the rotary joint is rotatably connected to the second bracket.

The first bracket comprises an end face opposite to the second bracket; the end face protrudes to form a first connecting block, and the end face comprises a plurality of first V-shaped grooves circumferentially disposed around the first connecting block. The second bracket comprises an end face opposite to the first bracket; the end face comprises a first bulge corresponding to the plurality of first V-shaped grooves; the end face comprises a first through hole to receive the first connecting block.

The second bracket is inserted in the first through hole and rotatable around the first connecting block, and then the first bulge is fitted to one of the plurality of first grooves. To drive the second bracket to rotate, a drive force is applied to the first bulge to move the first bulge in another first groove. Thus, the second bracket is rotatable. When the second bracket is at rest in the first through hole, the first bulge is embedded in one of the plurality of first grooves, which can prevent the movement of the second bracket.

The first subunit and the second subunit of the second bracket are disposed in a clamping way; the first subunit is disposed between the second subunit and the rotary joint; the first subunit comprises a hook; the second subunit comprises a second through hole receiving the hook; the hook is fixed in the second through hole. When the first subunit is connected to the second subunit, the first through hole is formed.

The lamp comprises a housing provided with a curved groove; the curved groove comprises a chute; the rotary joint comprises an end face opposite to the lamp, and the end face comprises a boss; and the boss is disposed and slidable in the chute so that the lamp is capable of moving with respect to the rotary joint.

Further, the first connecting block is provided with a positioning block. The first subunit is connected to the second subunit in a clamping way, so that the first connecting block is clamped in the first through hole in a position between the positioning block and the end-face of the first bracket. The positioning block abuts on the inner wall surrounding the first through hole in the second bracket, preventing the movement of the first connecting block.

Further, one end of the first subunit away from the first bracket comprises a second through hole; one end of the rotary joint facing the second bracket protrudes to form a second connecting block; and the second connecting block is disposed in the second through hole. The rotary joint is rotatably connected to the second bracket through the second connecting block.

Further, the circumferential wall surrounding the second through hole comprises an identation; and the second connecting block comprises a location block disposed in the identation. When the positioning block is aligned with the identation, the second connecting block is plugged in the second through hole until the positioning block enters into the first subunit. When the second connecting block rotates, the first positioning block abuts on the inner wall of the second through hole in the first subunit, preventing the movement of the second connecting block.

Further, a plurality of second V-shaped grooves is circumferentially disposed around the second through hole; a plurality of third V-shaped grooves is disposed at two sides of the curved groove of the lamp; and the rotary joint comprises a second bulge cooperating with the plurality of second V-shaped grooves, and a third bulge cooperating with the plurality of third V-shaped grooves. Particularly, the second bulge and the third bulge are disposed on both sides of the rotary joint, respectively. When the lamp moves in the direction of the curved groove, the second bulge of the rotary joint is driven to the position of another second groove. When the lamp rotates, the third bulge is driven to the position of another third groove. When the lamp is not rotated, the second bulge is fitted to one of the plurality of second grooves and the third bulge fitted to one of the plurality of third grooves, preventing the movement of the lamp.

Further, the second bracket comprises a first stopper disposed on the inner surface of the circumferential wall surrounding the first through hole; and the positioning block is provided with a positioning rod. The first stopper cooperates with the positioning rod, limiting the rotation angle of the second bracket.

Further, the first subunit comprises a second stopper disposed on the inner surface of a circumferential wall surrounding the second through hole. The positioning block cooperates with the second stopper, limiting the rotary angle of the lamp.

The disclosure also provides an emergency light comprising a fixture body and the lamp fixture, the fixture body comprising at least one groove, and the first bracket of the lamp fixture being disposed in the at least one groove. Preferably, two grooves are symmetrically disposed on two sides of the fixture body, respectively, and each side of the fixture body is equipped with the lamp fixture.

The lamp fixture and the emergency light comprising the same can rotate flexibly.

BRIEF DESCRIPTION OF THE DRAWINGS

To further illustrate the invention, experiments detailing a lamp fixture and an emergency light comprising the same are described below. It should be noted that the following examples are intended to describe and not to limit the invention.

Example 1

As shown in FIGS. 1-5, an emergency light comprises two connecting grooves 5 on both sides thereof. Each of the two connecting grooves 5 is configured to receive a lamp fixture comprising a first bracket 1. The first bracket 1 of the lamp fixture clamped in one of the two connecting grooves 5. The two connecting grooves 5 are disposed symmetrically on both sides of the emergency light, respectively. Two lamp fixtures are disposed on both sides of the emergency light. The lamp fixture is provided with a lamp 4. The lamp 4 can rotate and moving with respect to the connecting groove.

Figure 1:
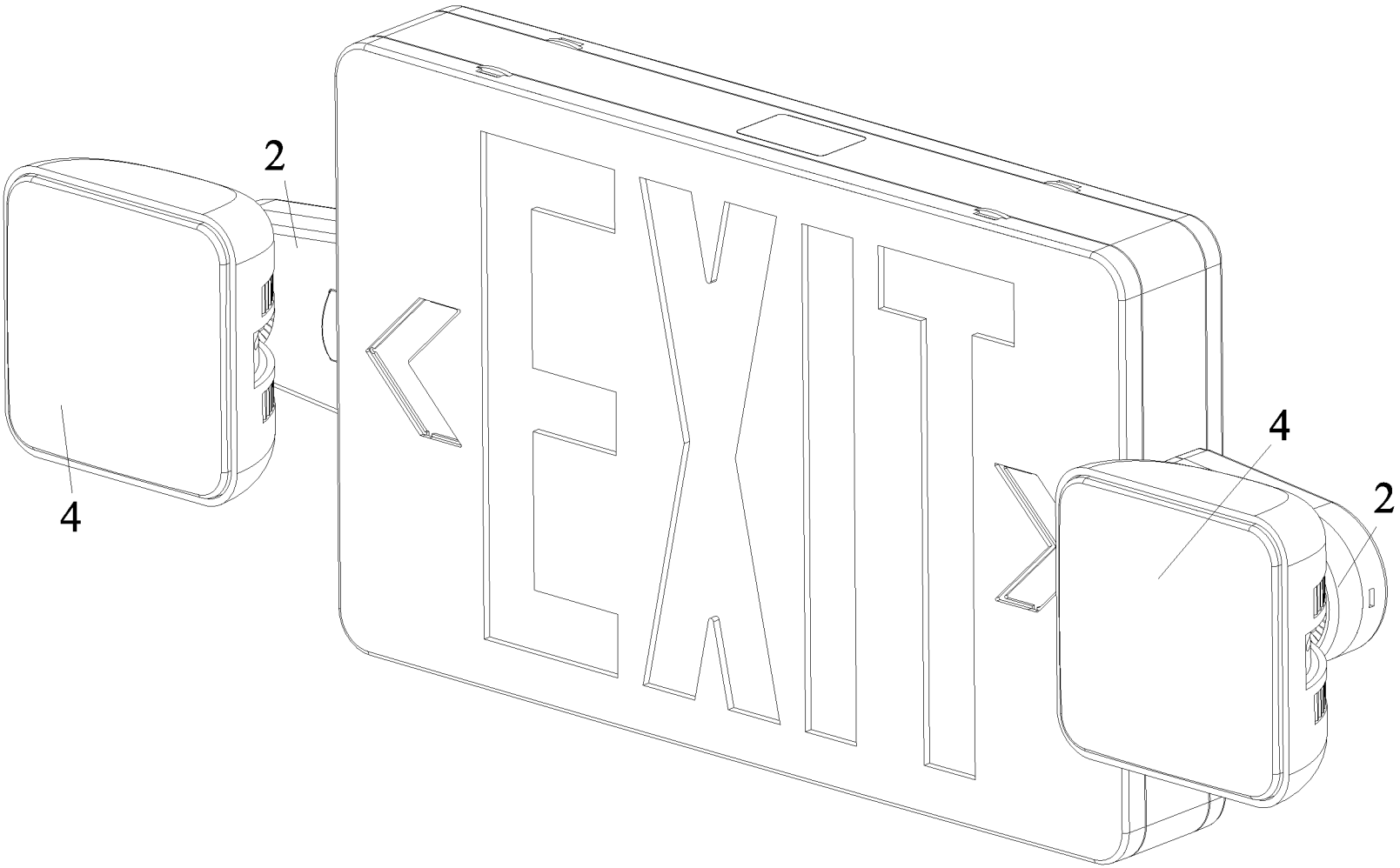
FIG. 1 shows a schematic diagram of an emergency light according to one embodiment of the disclosure.
Figure 2:
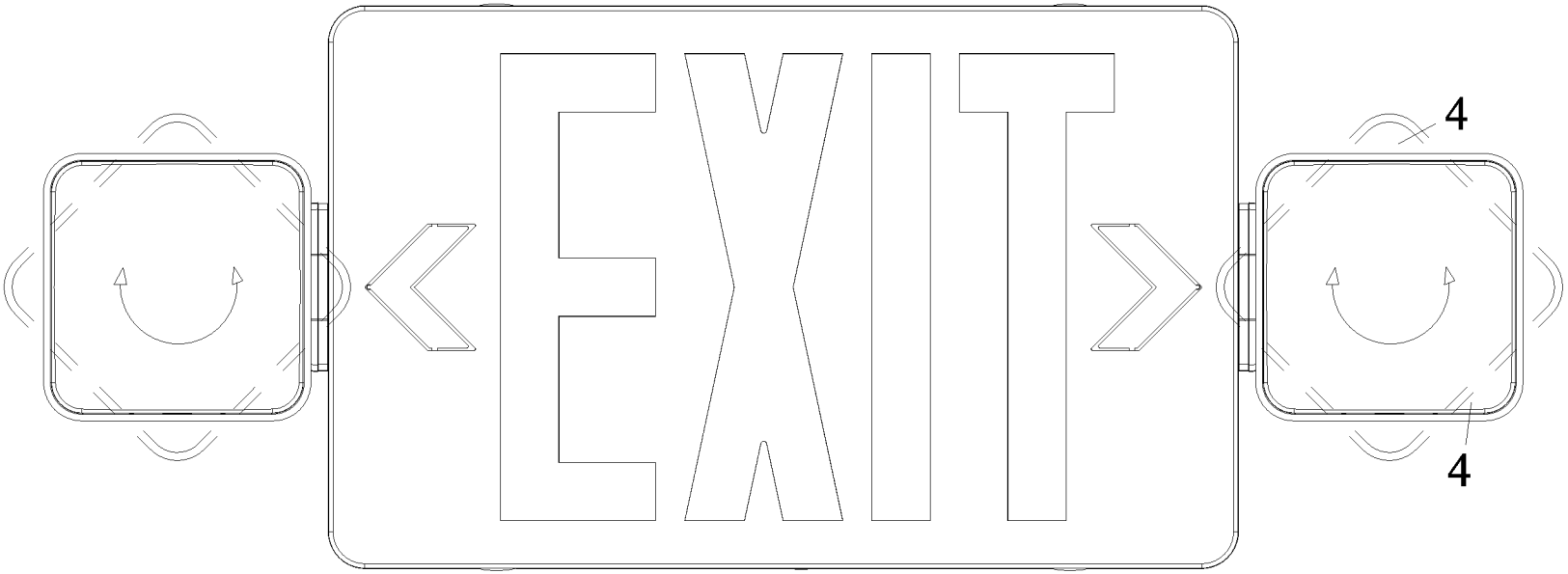
FIG. 2 is a schematic diagram showing the rotation of a lamp of an emergency light according to one embodiment of the disclosure.
Figure 3:
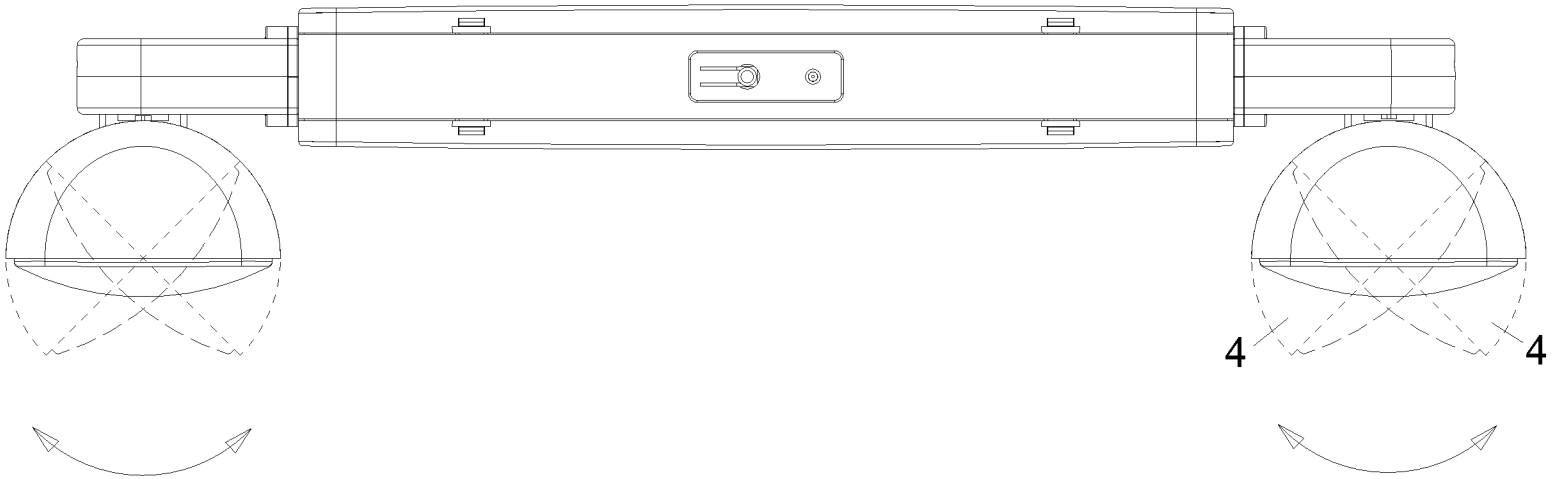
FIG. 3 is a schematic diagram showing the moving track of a lamp of an emergency light according to one embodiment of the disclosure.
Figures 4A, 4B, 4C:
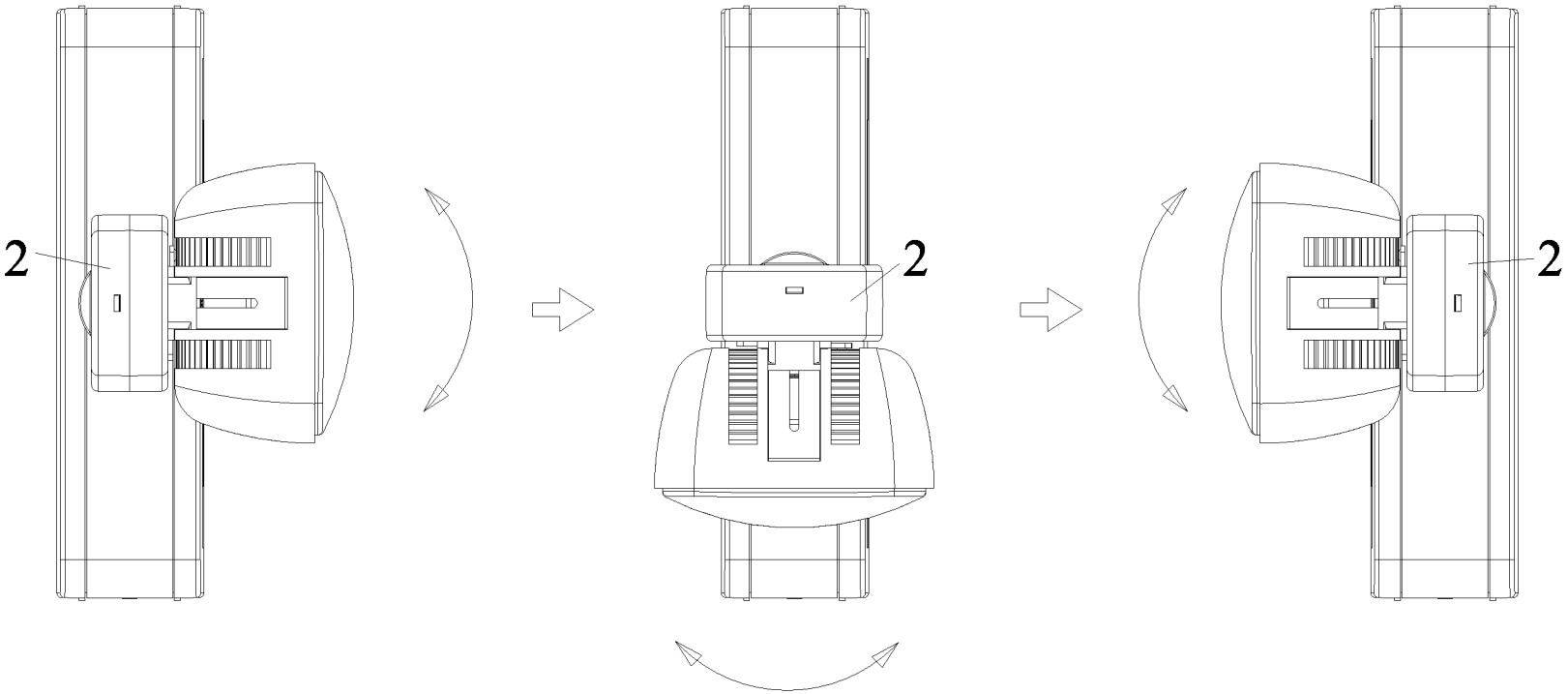
FIGS. 4A-4C are schematic diagrams showing the moving track of a second bracket of an emergency light according to one embodiment of the disclosure.
Figure 5:
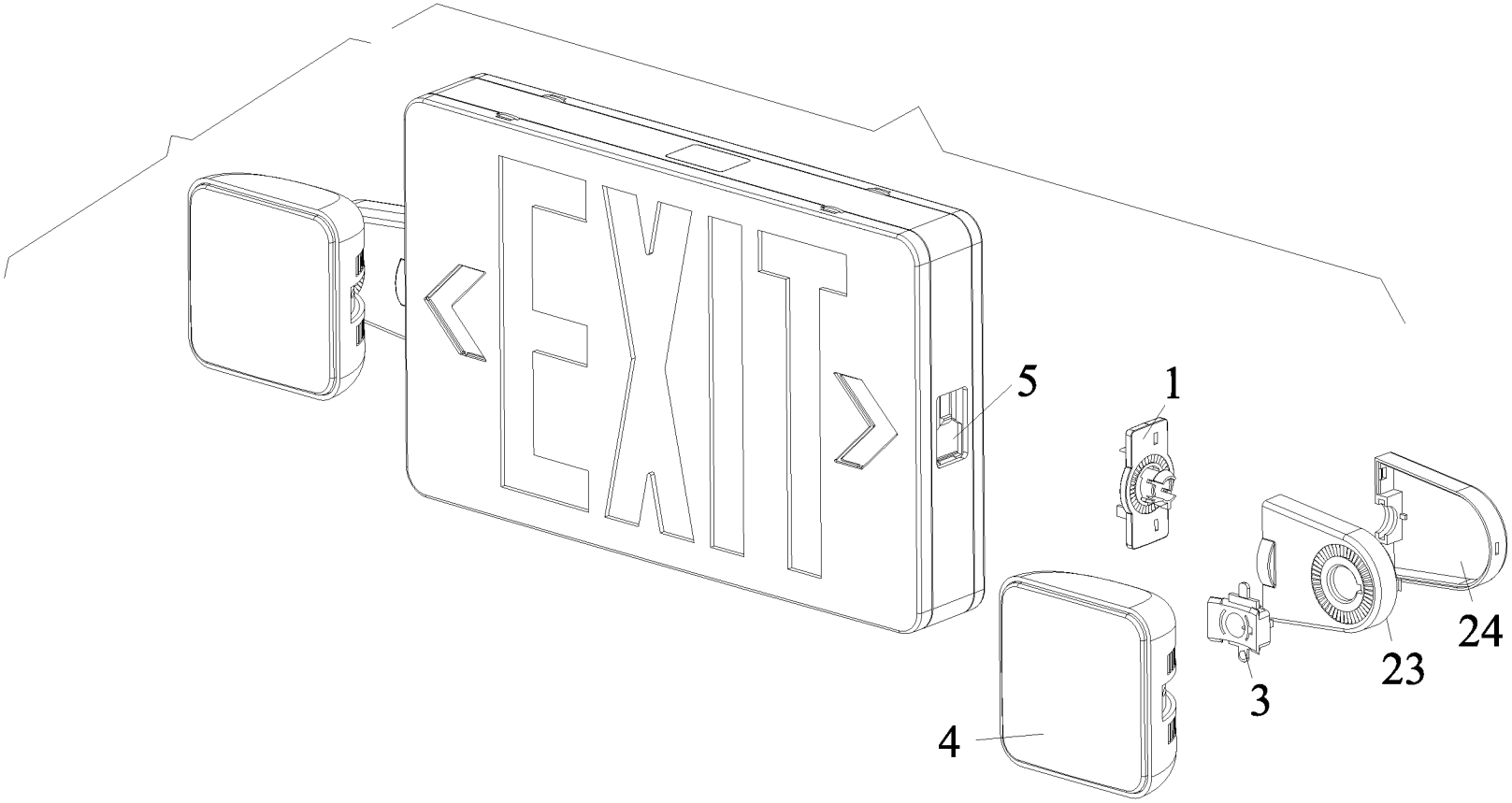
FIG. 5 is a schematic diagram of a lamp fixture of an emergency light according to one embodiment of the disclosure.
Figure 6:
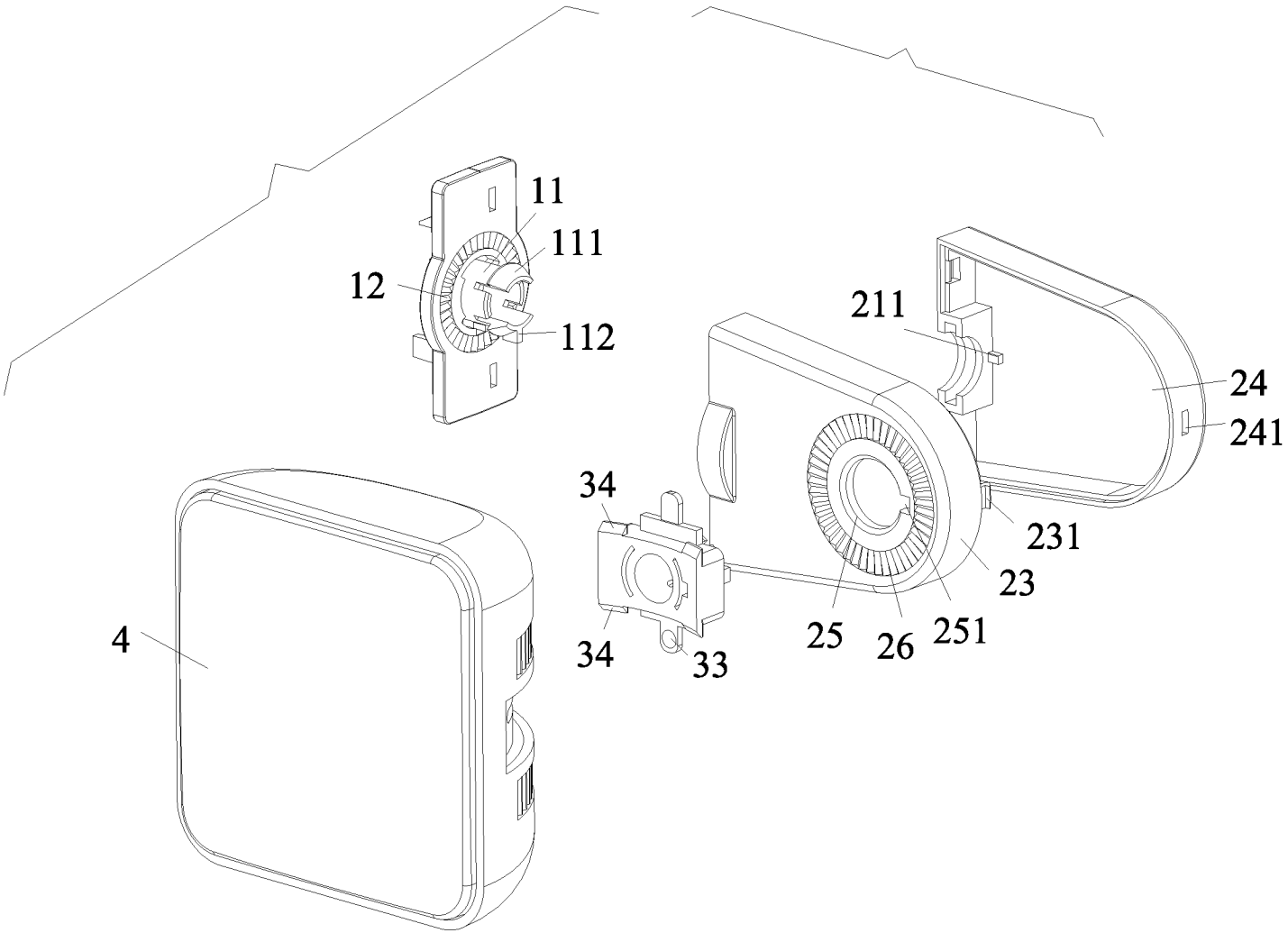
FIG. 6 is a first exploded view of a lamp fixture according to one embodiment of the disclosure.
Figure 7:
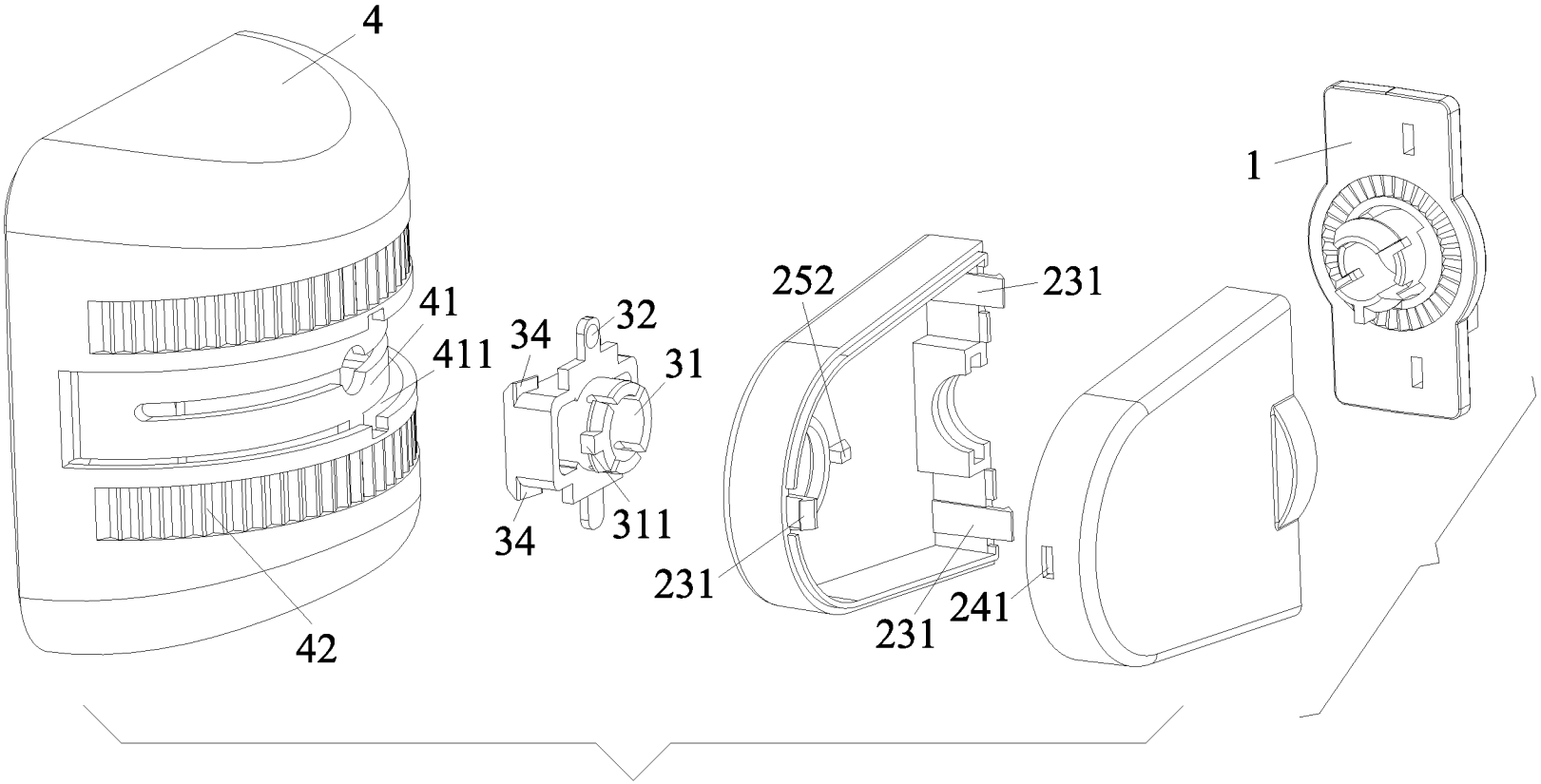
FIG. 7 is a second exploded view of a lamp fixture according to one embodiment of the disclosure.
Figure 8:
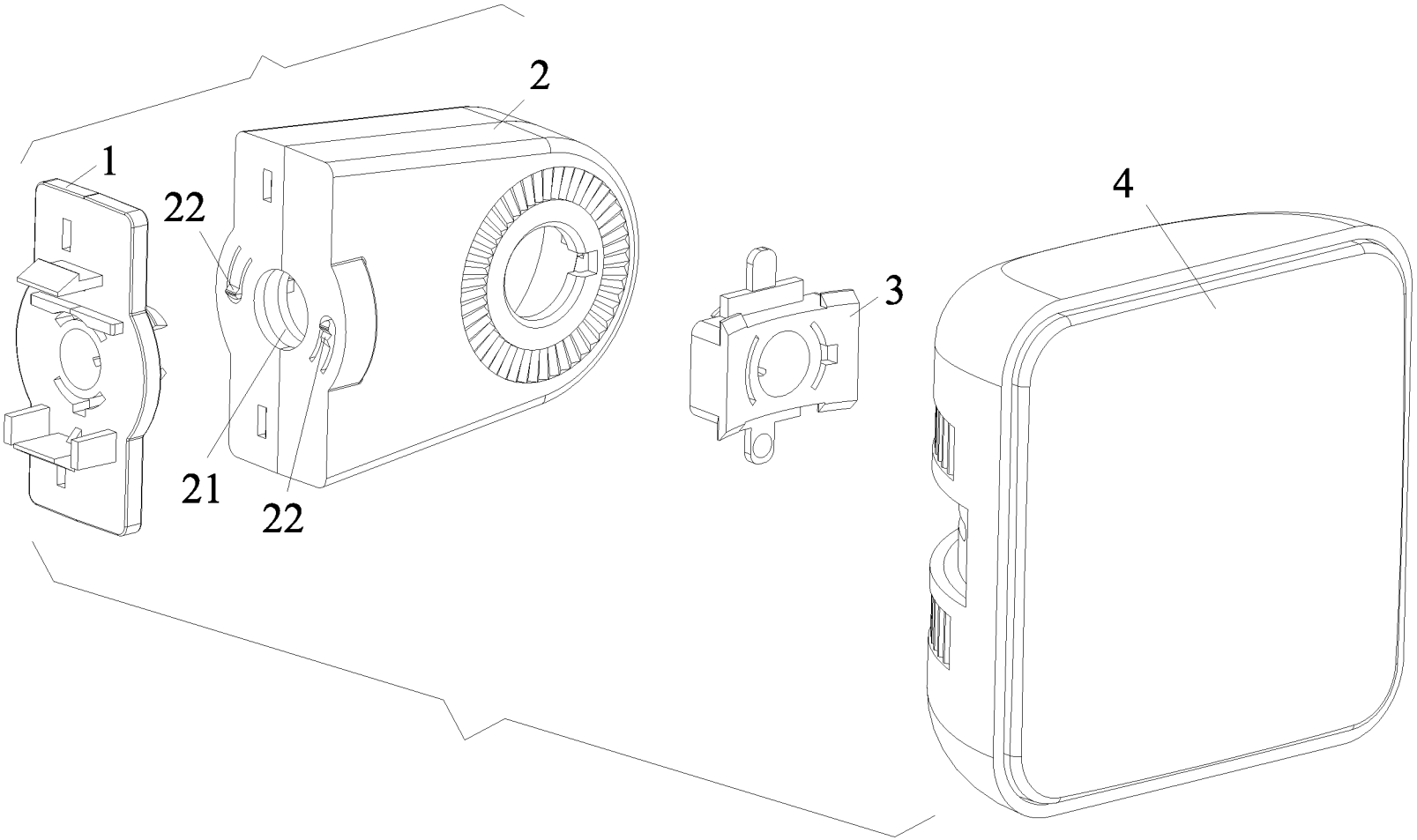
FIG. 8 is a third exploded view of a lamp fixture according to one embodiment of the disclosure.
Figure 9:
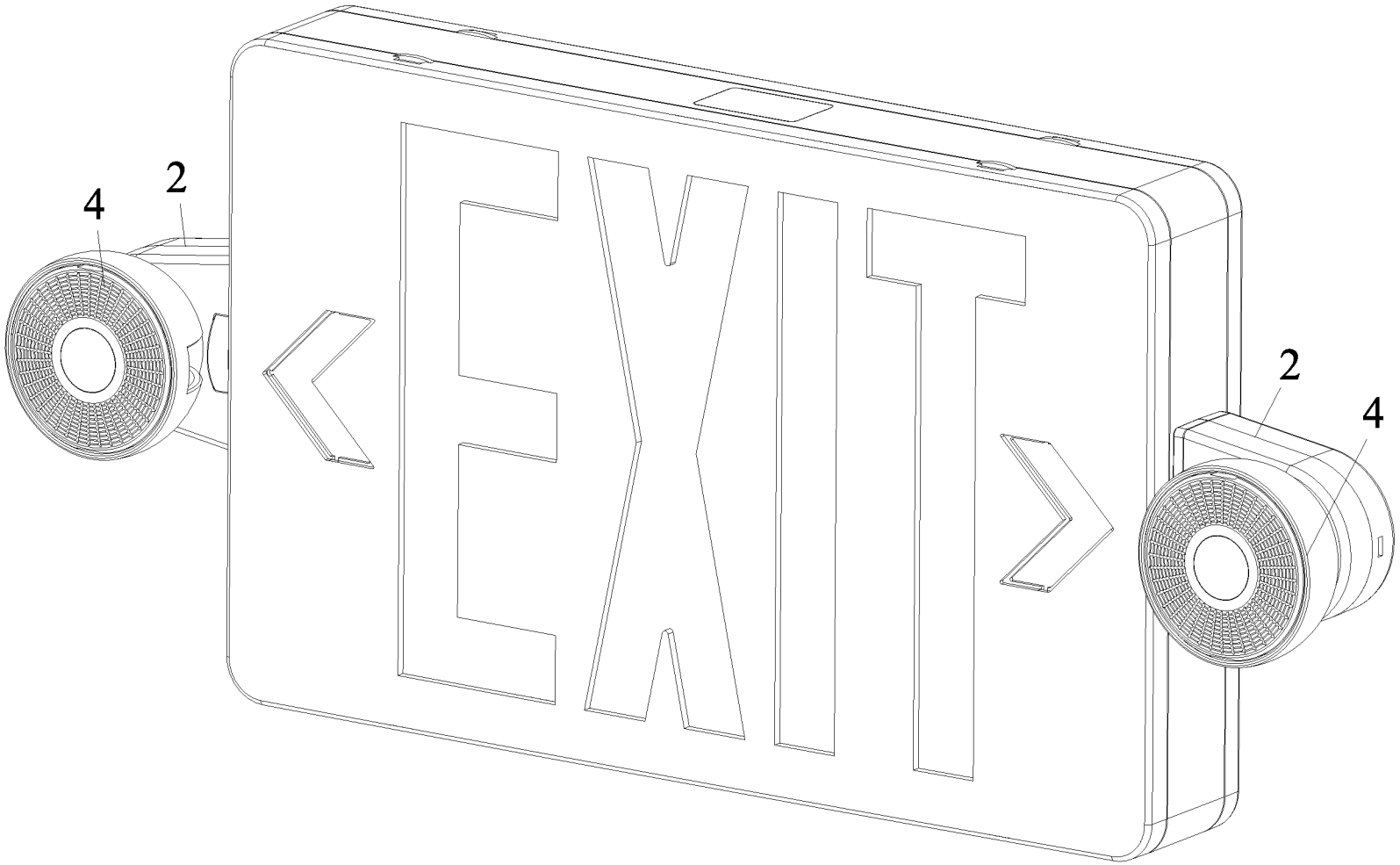
FIG. 9 is a schematic diagram of an emergency light according to another embodiment of the disclosure.
Figure 10B:
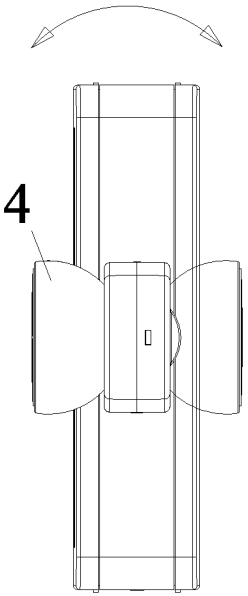
FIGS. 10A-10C are schematic diagrams showing the moving track of a lamp of an emergency light according to another embodiment of the disclosure.
Figure 10C:
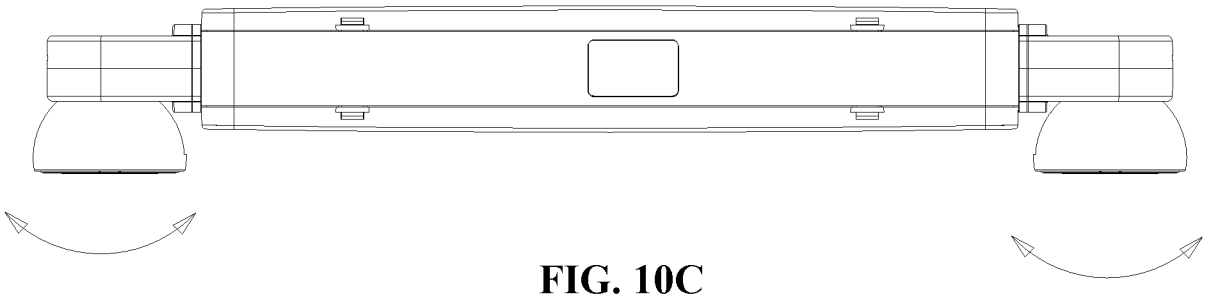
Figure 10A:
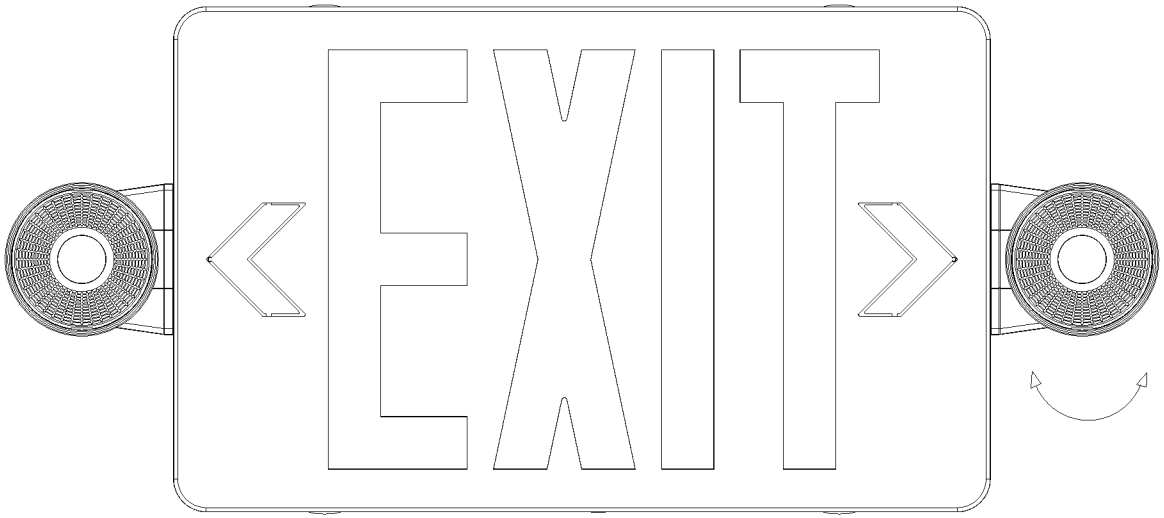

As shown in FIGS. 6-8, a lamp fixture comprises a first bracket 1, a second bracket 2, a rotary joint 3 and a lamp 4. The second bracket 2 is rotatably connected to the first bracket 1, and the second bracket 2 is connected to the lamp 4 through the rotary joint 3 which is rotatably connected to the second bracket 2.

The first bracket 1 comprises an end face opposite to the second bracket 2; the end face protrudes to form a first connecting block 11, and the end face comprises thirty-six first V-shaped grooves 12 circumferentially disposed around the first connecting block 11. The second bracket 2 comprises an end face opposite to the first bracket 1. The end face comprises a first bulge 22 corresponding to the plurality of first V-shaped grooves 12, and comprises a first through hole 21 to receive the first connecting block 11. The first connecting block 11 is provided with a positioning block 111.

The second bracket 2 comprises a first subunit 23 and a second subunit 24; the first subunit 23 is disposed between the second subunit 24 and the rotary joint 3. And the first subunit 23 comprises a hook 231. The second subunit 24 comprises a second through hole 241 receiving the hook 231; the hook 231 is fixed in the second through hole 241.

The lamp 4 comprises a housing provided with a curved groove 41 comprising a chute 411; the rotary joint 3 comprises an end face opposite to the lamp 4, and the end face comprises a boss 34. The boss 34 is disposed and slide in the chute 411 so that the lamp 4 is capable of moving with respect to the rotary joint 3.

One end of the first subunit 23 away from the first bracket 1 comprises a second through hole 25. One end of the rotary joint 3 facing the second bracket 2 protrudes to form a second connecting block 31. The second connecting block 31 is disposed in the second through hole 25. The circumferential wall surrounding the second through hole 25 comprises an identation 251; and the second connecting block 31 comprises a location block 311 disposed in the identation 251. Thirty-six second V-shaped grooves 26 are circumferentially disposed around the second through hole; a plurality of third V-shaped grooves 42 is disposed at two sides of the curved groove 41 of the lamp 4. The rotary joint 3 comprises a second bulge 32 cooperating with the thirty-six second V-shaped grooves 26, and a third bulge 33 cooperating with the thirty-six third V-shaped grooves 42. The second bulge 32 and the third bulge 33 are disposed on both sides of the rotary joint 3, respectively.

The second bracket 2 comprises a first stopper 211 disposed on the inner surface of the circumferential wall surrounding the first through hole 21. The positioning block 111 is provided with a positioning rod 112. The first subunit 23 comprises a second stopper 252 disposed on the inner surface of the circumferential wall surrounding the second through hole 25.

Example 2

As shown in FIGS. 9, 10A-10C, the disclosure provides an emergency light. Two lamp fixtures in Example 1 are symmetrically disposed on both sides of the emergency light. The light-emitting end of the lamp 4 is a circular structure. The movement track of the lamp 4 is the same as that of the lamp in Example 1.

It will be obvious to those skilled in the art that changes and modifications may be made, and therefore, the aim in the appended claims is to cover all such changes and modifications.

What is claimed is:

1. A device, comprising:

1) a first bracket;

2) a second bracket comprising a first subunit and a second subunit;

3) a rotary joint; and 4) a lamp;

wherein:

the second bracket is rotatably connected to the first bracket, the second bracket is connected to the lamp through the rotary joint, and the rotary joint is rotatably connected to the second bracket;

the first bracket comprises an end face opposite to the second bracket; the end face protrudes to form a first connecting block, and the end face comprises a plurality of first V-shaped grooves circumferentially disposed around the first connecting block;

the second bracket comprises an end face opposite to the first bracket; the end face comprises a first bulge corresponding to the plurality of first V-shaped grooves; the end face comprises a first through hole to receive the first connecting block;

the first subunit and the second subunit of the second bracket are disposed in a clamping way; the first subunit is disposed between the second subunit and the rotary joint; the first subunit comprises a hook; the second subunit comprises a second through hole receiving the hook; the hook is fixed in the second through hole; and the lamp comprises a housing provided with a curved groove; the curved groove comprises a chute; the rotary joint comprises an end face opposite to the lamp, and the end face comprises a boss; and the boss is disposed and slidable in the chute so that the lamp is capable of moving with respect to the rotary joint.

2. The device of claim 1, wherein the first connecting block is provided with a positioning block.

3. The device of claim 2, wherein one end of the first subunit away from the first bracket comprises a second through hole; one end of the rotary joint facing the second bracket protrudes to form a second connecting block; and the second connecting block is disposed in the second through hole.

4. The device of claim 3, wherein a circumferential wall surrounding the second through hole comprises an identation; and the second connecting block comprises a location block disposed in the identation.

5. The device of claim 4, wherein a plurality of second V-shaped grooves is circumferentially disposed around the second through hole; a plurality of third V-shaped grooves is disposed at two sides of the curved groove of the lamp; and the rotary joint comprises a second bulge cooperating with the plurality of second V-shaped grooves, and a third bulge cooperating with the plurality of third V-shaped grooves.

6. The device of claim 5, wherein the second bulge and the third bulge are disposed on both sides of the rotary joint, respectively.

7. The device of claim 6, wherein the second bracket comprises a first stopper disposed on an inner surface of the circumferential wall surrounding the first through hole; and the positioning block is provided with a positioning rod.

8. The device of claim 7, wherein the first subunit comprises a second stopper disposed on an inner surface of a circumferential wall surrounding the second through hole.

9. An emergency light, comprising a fixture body and the device of claim 1, the fixture body comprising at least one groove, and the first bracket of the device being disposed in the at least one groove.

10. The emergency light of claim 9, wherein two grooves are symmetrically disposed on two sides of the fixture body, respectively, and each side of the fixture body is equipped with the device.

* * * * *